US010635028B2

(12) United States Patent
Meguro

(10) Patent No.: US 10,635,028 B2
(45) Date of Patent: Apr. 28, 2020

(54) CLEANING DEVICE AND IMAGE FORMING APPARATUS

(71) Applicant: Konica Minolta, Inc., Chiyoda-ku, Tokyo (JP)

(72) Inventor: Taichi Meguro, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/381,081

(22) Filed: Apr. 11, 2019

(65) Prior Publication Data

US 2019/0339635 A1 Nov. 7, 2019

(30) Foreign Application Priority Data

May 2, 2018 (JP) ..... 2018-088793

(51) Int. Cl.
*G03G 15/16* (2006.01)
*G03G 21/00* (2006.01)

(52) U.S. Cl.
CPC ..... *G03G 15/161* (2013.01); *G03G 21/0011* (2013.01)

(58) Field of Classification Search
CPC ..... G03G 15/161; G03G 21/0005; G03G 21/007; G03G 21/10; G03G 21/0011; G03G 21/0058; G03G 21/0076; G03G 2215/1661; G03G 2221/001; G03G 2221/0005
See application file for complete search history.

(56) References Cited

U.S. PATENT DOCUMENTS 6,377,765 B1 * 4/2002 Shishido ..... G03G 15/0896 222/DIG. 1
2006/0034632 A1 * 2/2006 Takada ..... G03G 21/0011 399/101
2011/0280632 A1 * 11/2011 Douglas ..... G03G 15/065 399/265

FOREIGN PATENT DOCUMENTS

JP 2010-210697 9/2010
JP 2011095358 A * 5/2011

* cited by examiner

*Primary Examiner* — Thomas S Giampaolo, II
(74) *Attorney, Agent, or Firm* — BakerHostetler

(57) ABSTRACT

Provided is a cleaning device that prevents abrasion of a cut surface of a cleaning blade by stably supplying toner to the cleaning blade. The cleaning device includes a plate member, an applying roller and a cleaning blade. The cleaning blade comes in contact with the image carrier and cleans the image carrier. The applying roller comes in contact with the image carrier upstream of the cleaning blade in a conveying direction of the image carrier, and applies toner to the image carrier. The plate member comes in contact with the applying roller and applies the toner to the applying roller. Contact force of the plate member to the applying roller is 5 N or more and less than 40 N, and pressing force of the applying roller to the image carrier is 0.5 N or more and less than 40 N.

7 Claims, 4 Drawing Sheets

CLEANING DEVICE AND IMAGE FORMING APPARATUS

CROSS-REFERENCE TO RELATED APPLICATION

The entire disclosure of Japanese Patent Application No. 2018-088793, filed on May 2, 2018, is incorporated herein by reference in its entirety.

BACKGROUND

1. Technological Field

The present invention relates to a cleaning device and an image forming apparatus.

2. Description of the Related Art

In an electrophotographic image forming apparatus, a technique of cleaning an image earlier such as an intermediate transfer belt or a photoreceptor drum by a cleaning blade (hereinafter also simply referred to as "blade") is known. In particular, a stationary layer of external additive is formed by blocking the external additive detached from toner at the contact portion of the image carrier and the blade, and the image carrier is cleaned by blocking the toner by the stationary layer.

Such a stationary layer also has a function of preventing the blade from being entrained by the image carrier. In particular, since the external additive forming the stationary layer slightly passes through the contact portion of the image carrier and the blade, the contact area of the image carrier and the blade is reduced, so that the frictional force between the image carrier and the blade also decreases, and the blade is prevented from being entrained.

However, when low coverage images, images of which positions are biased in the axial direction of the photoreceptor drum, or the like are continuously printed, the supply amount of external additive added to the toner decreases, whereby the stationary layer is depleted. When the stationary layer is depleted, the blade is excessively entrained by the image carrier, so that abrasion of the cut surface of the blade (wear of the chamfered portion offset from the edge toward the cut surface side (upstream side of the rubbing contact)) may occur. When printing is continued in the state where abrasion of the cut surface has occurred, the edge of the blade wears with abrasion of the cut surface as a starting point, so that cleaning failure may occur. That is, in order to prevent cleaning failure, it is necessary to prevent abrasion of the cut surface of the blade and it is necessary to stably supply the toner to the blade.

In connection with the above, for example, a technique in which toner retained by a plurality of members disposed upstream of the blade is supplied to the blade by a roller is known. See Japanese Patent Publication No. 2011-95358. In this technique, the retained toner is attached to the image carrier due to van der Waals force acting between the toner and the image carrier, and is supplied to the blade by being conveyed by the image carrier.

SUMMARY

However, van der Waals force readily varies depending on temperature, humidity, surface condition of the image carrier, and the like. Therefore, in the technique described above, there are problems in that the toner is not stably supplied to the blade and abrasion of the cut surface of the blade cannot be prevented.

The present invention has been made in view of the above-described problems. Accordingly, an object of the present invention is to provide a cleaning device and an image forming apparatus that prevent abrasion of a cut surface of a cleaning blade by stably supplying toner to the cleaning blade.

To achieve at least one of the abovementioned objects, according to an aspect of the present invention, a cleaning device reflecting one aspect of the present invention, comprises: a cleaning blade that comes in contact with an image carrier and cleans the image carrier; an applying roller that comes in contact with the image carrier upstream of the cleaning blade in a conveying direction of the image carrier, and applies toner to the image carrier; and a plate member that comes in contact with the applying roller and applies the toner to the applying roller, wherein contact force of the plate member to the applying roller is 5 N or more and less than 40 N. and pressing force of the applying roller to the image carrier is 0.5 N or more and less than 40 N.

The objects, features, and characteristics of the present invention other than those set forth above will become apparent from the description given herein below with reference to preferred embodiments illustrated in the accompanying drawings.

BRIEF DESCRIPTION OF THE DRAWINGS

The advantages and features provided by one or more embodiments: of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
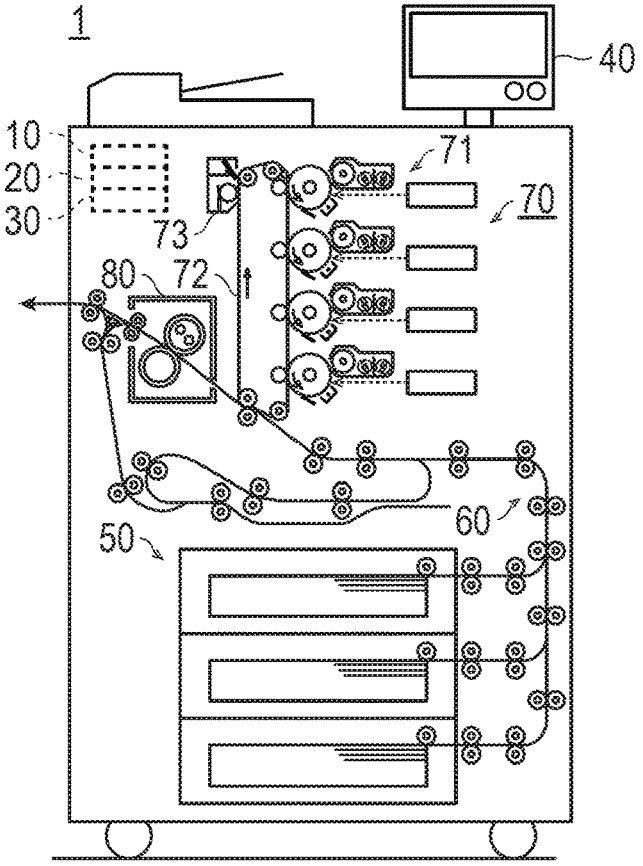
FIG. 1 is an illustration showing a schematic configuration of an image forming apparatus according to an embodiment of the present invention.

Hereinafter, one or more embodiments of the present invention will be described with reference to the drawings. However, the scope of the invention is not limited to the disclosed embodiments.

In the description of the drawings, the same elements are denoted by the same reference numerals, and duplicate descriptions are omitted. Also, the dimensional ratios of the drawings are exaggerated for convenience of explanation and may differ from the actual ratios.

Figure 2:
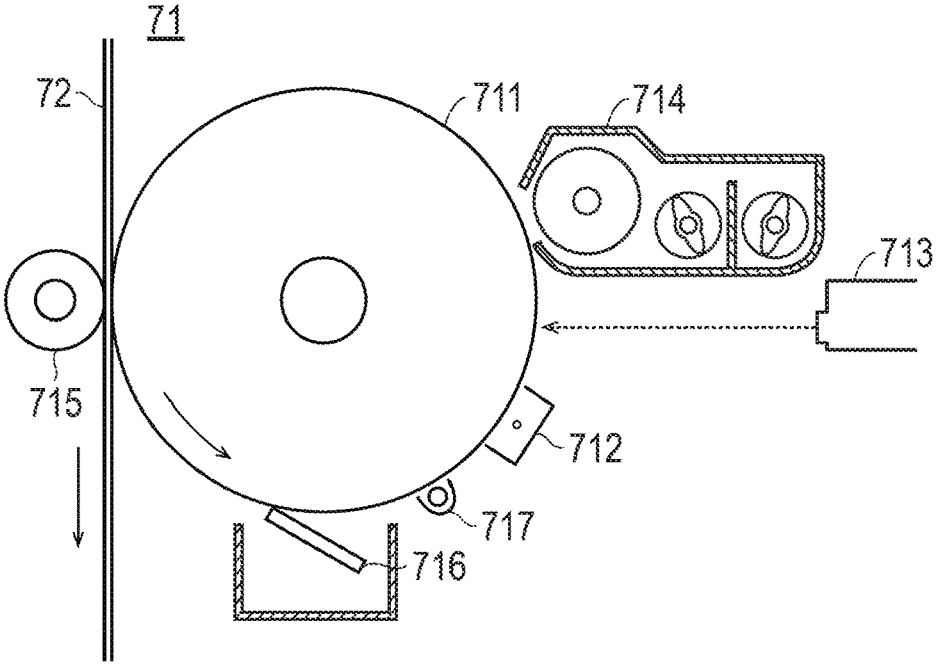
FIG. 2 is an illustration showing a schematic configuration of an image forming unit.

FIG. 1 is an illustration showing a schematic configuration of an image forming apparatus according to an embodiment of the present invention. FIG. 2 is an illustration showing a schematic configuration of an image forming unit.

As shown in FIG. 1, an image forming apparatus 1 includes a processor 10, a memory 20, a communicator 30, an operation panel 40, a sheet feeder 50, a conveyor 60, an image former 70, and a fixer 80. Respective components are mutually connected via a bus for exchanging signals.

The processor 10 is a CPU (Central Processing Unit), and performs control of each of the above components and various arithmetic processing according to a program.

The memory 20 includes a ROM (Read Only Memory) for storing various programs and various data in advance, a RAM (Random Access Memory) for temporarily storing programs and data as a work area, a hard disk for storing various programs and various data, and the like.

The communicator 30 is an interface for communicating with another device such as a user's PC (Personal Computer) via a network such as a LAN (Local Area Network).

The operation panel 40 includes, for example, a touch panel, ten keys, a start button, a stop button, and the like, displays various information, and accepts various operations.

The sheet feeder 50 includes a sheet feed tray that accommodates paper to be used for printing, and feeds paper stored in the sheet feed tray one by one.

The conveyor 60 includes a conveying path, a plurality of pairs of conveying rollers disposed along the conveying path, and a driving motor (not shown) that drives the pairs of conveying rollers, and conveys the paper fed by the sheet feeder 50 along the conveying path.

The image former 70 includes an image forming unit 71 of each color such as yellow (Y), magenta (M), cyan (C), and black (K), an intermediate transfer belt 72, and a cleaning device 73 that cleans the intermediate transfer belt 72.

The image forming unit 71 forms an image by toner of each color. As shown in FIG. 2, each image forming unit 71 includes a photoreceptor drum 711 as an image carrier. Further, the image forming unit 71 includes, around the photoreceptor drum 711, a charging device 712, an exposing device 713, a developing device 714, a transfer roller 715, a cleaning device 716 and an eraser 717. The charging device 712 uniformly charges the surface of the photoreceptor drum 711 to a certain potential. The exposing device 713 exposes the surface of the photoreceptor drum 711 charged by the charging device 712, thereby forming an electrostatic latent image according to the image data. The developing device 714 develops the electrostatic latent image formed by the exposing device 713 into a toner image. The transfer roller 715 transfers the toner image formed by the developing device 714 and conveyed by the photoreceptor drum 711 to the intermediate transfer belt 72. The cleaning device 716 blocks the toner and the like on the photoreceptor drum 711 by a cleaning blade or the like, and cleans the photoreceptor drum 711. The eraser 717 removes static electricity from the surface of the photoreceptor drum 711.

As shown in FIG. 1, the intermediate transfer belt 72, as an image carrier, is an endless belt movably supported by a plurality of rollers. The intermediate transfer belt 72 conveys the toner image transferred by the transfer roller 715 of the image forming unit 71 in the primary transfer area to the secondary transfer area, and transfers the toner image to the paper in the secondary transfer area. The intermediate transfer belt 72 may be, for example, a semiconductor belt made of polyimide and having a volume resistivity of 8 to 11 LOG Ω·cm and a thickness of 80 μm.

As described above the intermediate transfer belt 72 includes the cleaning device 73 that cleans the intermediate transfer belt 72. Details of the cleaning device 73 will be described later with reference to FIG. 3.

The fixer 80 includes a heating roller and a pressure roller, heats and pressurizes the paper on which the image is formed by the image former 70, and fixes the image on the paper.

Note that the image forming apparatus 1 may include constituent elements other than the above-described constituent elements, or may not include part of the above-described constituent elements.

Next, referring to FIG. 3, details of the cleaning device 73 that cleans the intermediate transfer belt 72 will be described.

Figure 3:
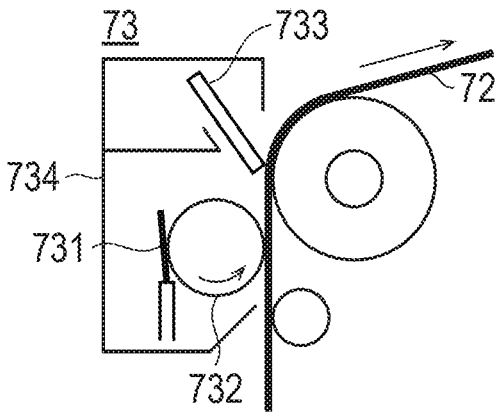
FIG. 3 is an illustration showing a schematic configuration of a cleaning device.

FIG. 3 is an illustration showing a schematic configuration of the cleaning device.

As shown in FIG. 3, the cleaning device 73 includes a plate member 731, an applying roller 732, a cleaning blade (blade) 733, and a housing 734 that houses them.

The plate member 731 is a plate-like member that comes in contact with the applying roller 732, and applies toner to the applying roller 732. In the present embodiment, the plate member 731 is disposed so as to come in contact with the applying roller 732 by a predetermined contact force. As shown in FIG. 3, one end (upper end) of the plate member 731 is preferably a free end. Further, the other end (lower end) of the plate member 731 is preferably, for example, a fixed end fixed to a holder attached to the housing 734:

It is preferable that the plate member 731 be a metal leaf spring material in order to avoid a creep deformation of the plate member 731. The material of the plate member 731 includes, for example, a stainless steel strip or the like for spring such as SUS301-CSP, SUS304-CSP, or SUS361-CSP, but not limited thereto. Further, it is preferable that the plate member 731 have a thickness of 50 μm or more and less than 200 μm, in order to ensure followability to the applying roller 732 while ensuring the contact force against the applying roller 732.

Next, the applying roller 732 is a member that rotates while coming in contact with the intermediate transfer belt 72, and applies the toner applied by the plate member 731 to the intermediate transfer belt 72. In the present embodiment, the applying roller 732 is disposed so as to press the intermediate transfer belt 72 by a predetermined pressing force.

The applying roller 732 preferably has an elastic layer in order to have a predetermined nip between the plate member 731 and the applying roller 732, and a predetermined nip between the intermediate transfer belt 72 and the applying roller 732. Further, it is preferable that the elastic layer be composed of a foamed sponge in order to holds a sufficient amount of toner on the surface of the applying roller 732. It is preferable that the foamed sponge constituting the elastic layer have a cell diameter of 100 μm or more and 350 μm or less, and the cell occupancy rate per unit area be 30% or more and less than 70%. In the present embodiment, the cell occupancy rate per unit area is a value obtained by dividing a total value of the area of the cells (cell area) existing within the unit area (1 mm×1 mm) on the surface of the applying roller 732 by the unit area.

Next, the blade 733 is a flat plate member that comes in contact with the intermediate transfer belt 72, and cleans the intermediate transfer belt 72. As shown in FIG. 3, the blade 733 comes in contact with the intermediate transfer belt 72 downstream of the applying roller 732 in the conveying direction of the intermediate transfer belt 72, in the counter direction with respect to the conveying direction of the intermediate transfer belt 72. For this reason, external additive detached from the toner applied by the applying roller 732 are blocked at the contact portion of the intermediate transfer belt 72 and the blade 733, and a stationary layer of the external additive is formed. The blade 733 blocks the toner and the like on the intermediate transfer belt 72 by the stationary layer, and cleans the intermediate transfer belt 72.

The blade 733 may be composed of, for example, urethane rubber in order to achieve a desired cleaning performance for the toner, and the contact pressure of the blade 733 against the intermediate transfer belt 72 may be 15 to 40 N/m and the contact angle may be 14 to 23°. However, the material of the blade 733 and the contact condition with respect to the intermediate transfer belt 72, and the like are not limited to these examples, and may be set so that a desired cleaning performance can be achieved.

In the cleaning device 73 configured as described above, the toner applied to the applying roller 732 by the plate member 731 is applied to the intermediate transfer belt 72 by the applying roller 732. Then, the toner applied to the intermediate transfer belt 72 is conveyed by the intermediate transfer belt 72 to be supplied to the blade 733. Hereinafter, more detailed conditions of each configuration of the cleaning device 73 will be described.

(Setting of Contact Force and Pressing Force)

The amount of toner applied to the applying roller 732 by the plate member 731 is controlled by the contact force of the plate member 731 to the applying roller 732 (hereinafter also simply referred to as "contact force"). Further, the amount of toner applied to the intermediate transfer belt 72 by the applying roller 732, and supplied to the blade 733, is controlled by the pressing force of the applying roller 732 to the intermediate transfer belt 72 (hereinafter also simply referred to as "pressing force").

In order to supply to the blade 733 the amount of toner necessary for preventing abrasion of the cut surface, it is necessary to set, to an appropriate range, the contact force of the plate member 731 to the applying roller 732 and the pressing force of the applying roller 732 to the intermediate transfer belt 72. Further, when the toner is excessively supplied to the blade 733, the blade 733 cannot completely clean the toner, and cleaning failure of the blade 733 due to an excessive amount of toner occurs. For this reason, it is preferable to set each upper limit value in addition to each lower limit as the threshold of the contact force and the pressing force.

In an embodiment, the contact force of the plate member 731 to the applying roller 732 is preferably set to 5 N or more and less than 40 N, more preferably, 15 N or more and less than 30 N. The amount of toner applied to the applying roller 732 by the plate member 731 (the adhesion amount of toner on the applying roller 732) is controlled to be 5 g/m$^2$ or more and less than 50 g/m$^2$ by setting the contact force of the plate member 731 to 5 N or more and less than 40 N.

The pressing force of the applying roller 732 to the intermediate transfer belt 72 is preferably set to 0.5 N or more and less than 40 N, more preferably, 10 N or more and less than 20 N. The contact force of the plate member 731 is set to 5 N or more and less than 40 N and the pressing force of the applying roller 732 is set to 0.5 N or more and less than 40 N, so that the amount of toner applied to the intermediate transfer belt 72 by the applying roller 732, and supplied to the blade 733, is controlled to be 0.5 g/m$^2$ or more and less than 4 g/m$^2$. The amount of toner supplied to the blade 733 corresponds to the adhesion amount of toner on the intermediate transfer belt 72. In this way, the amount of toner supplied to the blade 733 is controlled to the amount of toner so that cleaning failure of the blade 733 can be prevented while abrasion of the cut surface of the blade 733 can be prevented.

Although it has been described that the amount of toner applied to the applying roller 732 by the plate member 731 is controlled by the contact force of the plate member 731 to the applying roller 732, the present embodiment is not limited thereto. The amount of toner applied to the applying roller 732 by the plate member 731 may be controlled, for example, by the bite amount of the plate member 731 to the applying roller 732. It is preferable that the bite amount be set to 0.5 mm or more and less than 3 mm so that the plate member 731 has a predetermined contact force to apply a necessary amount of toner to the applying roller 732, and not to apply an excessive amount of toner to the applying roller 732. The bite amount of 0.5 mm or more and less than 3 mm may correspond to the contact force of 5 N or more and less than 40 N.

Further, in the present embodiment, the bite amount of the plate member 731 to the applying roller 732 is defined as 0 mm when the plate member 731 and the applying roller 732 are in contact with each other at the contact force 0. The bite amount increases by bringing the plate member 731 closer to the center portion of the applying roller 732, on the straight line connecting the center point of the applying roller 732 and the contact portion of the plate member 731 and the applying roller 732.

(Non-Edge Contact)

In the present embodiment, as shown in FIG. 3, the plate member 731 is disposed such that the non-edge portion of the plate member 731 comes in contact (also referred to as "belly contact" or "non-edge contact") with the applying roller 732. In this regard, more detail will be explained with reference to FIGS. 4A and 4B.

Figure 4A:
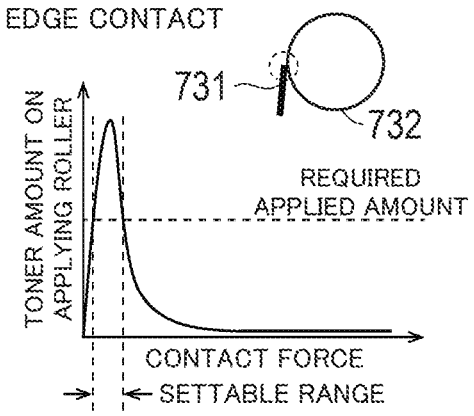
FIGS. 4A and 4B are illustrations for explaining a contacting method of a plate member.
Figure 4B:
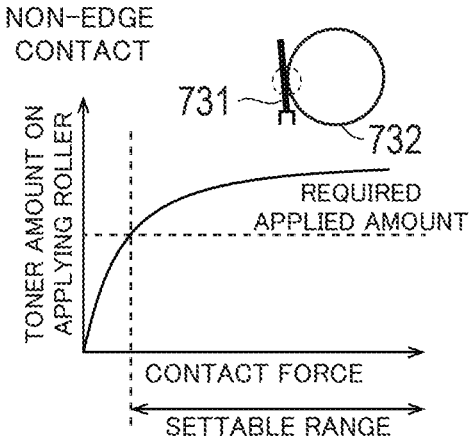

FIGS. 4A and 4B are illustrations for explaining a contacting method of the plate member.

FIG. 4A shows the relationship between the contact force of the plate member 731 and the amount of toner applied to the applying roller 732 when the edge portion of the plate member 731 comes in contact (edge contact) with the applying roller 732. When the contact force at the edge contact is large, the plate member 731 to apply the toner to the applying roller 732 scrapes off the toner from the applying roller 732, and the required amount of applied toner cannot be secured. For this reason, in case of edge contact, the settable range of contact force is narrow as shown in FIG. 4A. Also, when the contact force at the edge contact is large, the edge portion of the plate member 731 may damage or degrade the surface of the applying roller 732, so that the settable upper limit value of contact three is small from the viewpoint of protecting, the surface of the applying roller 732.

Further, even when contact force capable of applying a necessary amount of toner is set, an error of the contact force may occur due to, for example, variations of the use environment of the cleaning device 73 and the dimensions of each component. As mentioned above; in case of edge contact, since the settable range of contact force is narrow, there is a possibility that the required amount of applied toner cannot be secured if even a slight error of the contact force occurs.

Therefore, in the present embodiment, the plate member 731 is disposed so as to be in non-edge contact with the applying roller 732. FIG. 4B shows the relationship between the contact force of the plate member 731 and the amount of toner applied to the applying roller 732 in the case of non-edge contact. In the case of non-edge contact, since the plate member 731 does not scrape off the toner from the applying roller 732 regardless of the magnitude of the contact force, the settable range of contact force is wide. Also, in the case of non-edge contact, the edge portion of the plate member 731 does not damage or degrade the surface of the applying roller 732, and even when an error of the contact force occurs, the required amount of applied toner is secured.

(Formation of Storage Space)

In the present embodiment, as shown in FIG. 3, the plate member 731 and the applying roller 732 are disposed so as to form a space for storing the toner above the contact portion of the plate member 731 and the applying roller 732. In this regard, more detail will be explained with reference to FIGS. 5 and 6.

Figure 5:
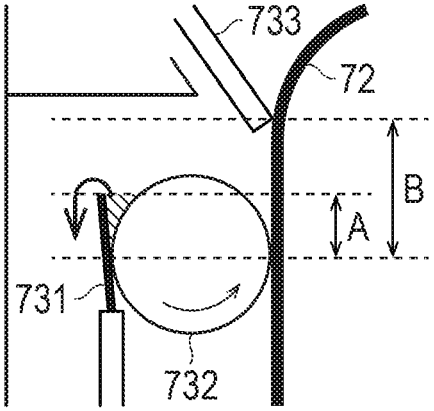
FIG. 5 is an illustration for explaining an example of a toner storage space.
Figure 6:
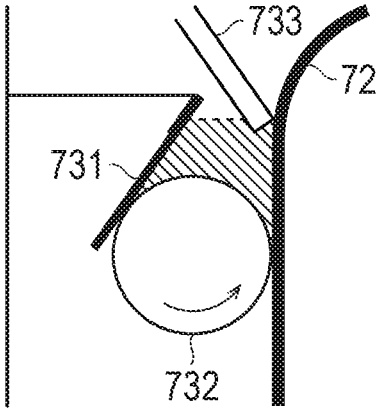
FIG. 6 is an illustration for explaining an example of a toner storage space.

FIGS. 5 and 6 are illustrations for explaining an example of a toner storage space.

As shown in FIG. 5, the plate member 731 and the applying roller 732 are configured to store the toner in the toner storage space (hatched area in FIG. 5) formed above the contact portion (in the direction opposite to the direction of gravity). As described above, the plate member 731 comes in contact with the applying roller 732 by a predetermined contact force, and applies the toner stored in the storage space to the applying roller 732 at the contact portion.

However, when the toner is excessively stored in the storage space and excessively supplied to the blade 733, cleaning failure occurs. For example, as shown in FIG. 6, it is assumed that the upper end of the plate member 731 is set higher than the lower end of the blade 733. In this case, an excessive amount of toner is stored (over-stored) in the storage space (hatched area in FIG. 6), reaches the lower end of the blade 733, and changes the attitude of the blade 733 due to the powder pressure of the toner, whereby cleaning failure occurs.

Therefore, in the present embodiment, as shown in FIG. 5, the upper end of the plate member 731 is configured to be a free end, and the toner exceeding the capacity of the storage space falls from the free end in the direction of the arrow, and is discharged. That is, there is a space above the free end of the plate member 731 to overflow toner from the storage space. Further, in order to discharge the toner exceeding the capacity of the storage space, the configuration is such that the distance from the free end of the plate member 731 to the housing 734 is a predetermined distance or more in the horizontal direction and the vertical direction.

Further, the position of the upper end of the plate member 731 is set to be lower than the position of the lower end of the blade 733. In other words, as shown in FIG. 5, the height A from the contact portion of the plate member 731 and the applying roller 732 to the upper end of the plate member 731 is set to be lower than the height B from the contact portion to the lower end of the blade 733. The height A corresponds to the maximum height from the contact portion to the liquid level of the toner. That is, when the relationship of A<B is satisfied, the liquid level of the toner does not reach the lower end of the blade 733, so that cleaning failure due to excessive storage is prevented.

As described above, the cleaning device 73 includes a blade 733 that comes in contact with the intermediate transfer belt 72, the applying roller 732 that comes in contact with the intermediate transfer belt 72 upstream of the blade 733 in the conveying direction of the intermediate transfer belt 72, and the plate member 731 that comes in contact with the applying roller 732. The contact force of the plate member 731 to the applying roller 732 is set to 5 Nor more and less than 40 N, and the pressing force of the applying roller 732 to the intermediate transfer belt 72 is set to 0.5 N or more and less than 40 N. In this way, the amount of toner necessary for preventing abrasion of the cut surface is stably supplied to the blade 733, and abrasion of the cut surface of the blade 733 can be effectively prevented. Further, since the toner is not excessively supplied to the blade 733, cleaning failure of the blade 733 due to an excessive amount of toner can be also prevented.

Further, the plate member 731 is disposed so that the non-edge portion of the plate member 731 comes in contact with the applying roller 732. In this way, since the plate member 731 does not scrape off the toner from the applying roller 732 regardless of the magnitude of the contact force of the plate member 731, the settable range of contact force is widened. Further, the edge portion of the plate member 731 does not damage or degrade the surface of the applying roller 732, and even when an error of the contact force occurs, the required amount of applied toner is secured.

Further, the plate member 731 and the applying roller 732 are disposed so as to form a space for storing the toner above the contact portion of the plate member 731 and the applying roller 732. In this way, the cleaning device 73 can form a storage space only by the configuration of the plate member 731 and the applying roller 732, without requiring a complicated configuration, and can store the toner in the storage space. In addition, the plate member 731 applies the toner stored in the storage space to the applying roller 732, and the toner exceeding the capacity of the storage space is discharged downward from the upper end of the plate member 731. In this way, the plate member 731 can surely apply the amount of toner necessary for preventing abrasion of the cut surface which is stored in the storage space, to the applying roller 732. Further, since the plate member 731 is configured to discharge an excessive amount of toner, cleaning failure due to excessive storage is also prevented.

Further, the position of the upper end of the plate member 731 is set to be lower than the position of the lower end of the blade 733. In this way, since the liquid level of the toner does not reach the lower end of the blade 733, cleaning failure due to excessive storage is prevented.

The amount of toner applied to the applying roller 732 by the plate member 731 is set to 5 $g/m^2$ or more and less than 50 $g/m^2$. Then, the amount of toner applied to the intermediate transfer belt 72 by the applying roller 732, and supplied to the blade 733, is set to 0.5 $g/m^2$ or more and less than 4 $g/m^2$. Abrasion of the cut surface of the blade 733 is effectively prevented by stably supplying the above-described amount of toner to the blade 733.

Further, the plate member 731 is a metal leaf spring material having a thickness of 50 μm or more and less than 200 μm. In this way, a creep deformation of the plate member 731, which can occur when the plate member 731 is made of, for example, PET (polyethylene terephthalate) or is not a leaf spring material, is avoided. Therefore, the applying performance of the plate member 731 to the applying roller 732 is secured. Even when the applying roller 732 has a partial variation in the outer diameter, surface condition or the like, the plate member 731 can ensure the followability to the applying roller 732 to form a stable predetermined nip between the plate member 731 and the applying roller 732.

Further, the bite amount of the plate member 731 to the applying roller 732 is set to 0.5 mm or more and less than 3 mm. In this way, the plate member 731 has a predetermined contact force to apply a necessary amount of toner to the applying roller 732, and not to apply an excessive amount of toner to the applying roller 732.

Further, the applying roller 732 has an elastic layer composed of a foamed sponge. In this way, even when the applying roller 732 is inclined in the axial direction of the applying roller 732 or has a partial variation in the outer diameter, the applying roller 732 can absorb the inclination and variation by the elastic layer. Therefore, the applying roller 732 can form stable a predetermined nip between the plate member 731 and the applying roller 732, and a predetermined nip between the intermediate transfer belt 72 and the applying roller 732. Since the applying roller 732 is not completely separated from each of the plate member 731 and the intermediate transfer belt 72, the toner can be stably supplied from the plate member 731, and can be also stably supplied to the intermediate transfer belt 72.

It should be noted that the present invention is not limited to only the above-described embodiments, and various modifications, improvements, and the like are possible within the scope of the claims.

For example, in the above-described embodiment, an example has been described in which abrasion of the cut surface of the blade 733 is prevented in the cleaning device 73 that cleans the intermediate transfer belt 72. However, the cleaning device to which the present invention is applied is not limited to the cleaning device 73 that cleans the intermediate transfer belt 72, and may be the cleaning device 716 that cleans the photoreceptor drum 711. That is, the present invention may be applied to the cleaning device 716 in order to prevent abrasion of the cut surface of the cleaning blade in the cleaning device 716 that cleans the photoreceptor drum 711.

Further, in the above-described embodiment, it has been described that the plate member 731 and the applying roller 732 form a toner storage space as shown in FIG. 5. However, the shape of the toner storage space formed by the plate member 731 and the applying roller 732 is not limited to the example shown in FIG. 5.

FIGS. 7A to 7D are illustrations for explaining another example of a toner storage space.

The plate member 731 and the applying roller 732 may form a toner storage space as illustrated in FIGS. 7A to 7D above the contact portion. Then, as in the example shown in FIG. 5, the plate member 731 may come in contact with the applying roller 732 by a predetermined contact force, and apply the toner stored in the storage space to the applying roller 732 at the contact portion. Note that, as in the example shown in FIG. 5, it is preferable that the upper end of the plate member 731 be configured to be a free end, and the toner exceeding the capacity of the storage space be discharged downward from the free end. Further, it is preferable that the position of the upper end of the plate member 731 be set to be lower than the position of the lower end of the blade 733.

Figure 7A:
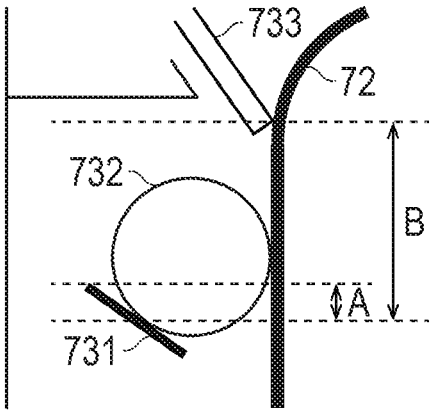
FIGS. 7A to 7D are illustrations for explaining another example of a toner storage space.
Figure 7B:
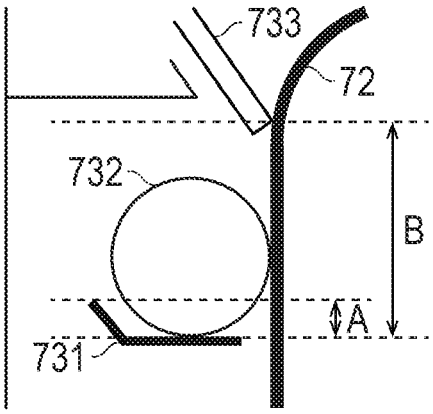
Figure 7C:
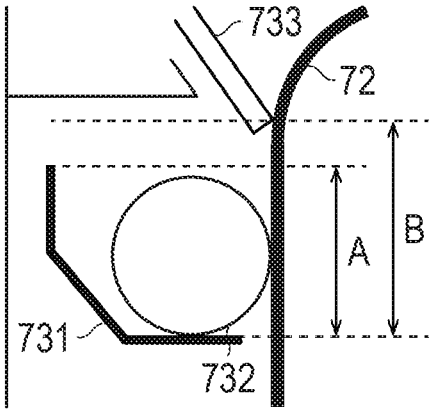
Figure 7D:
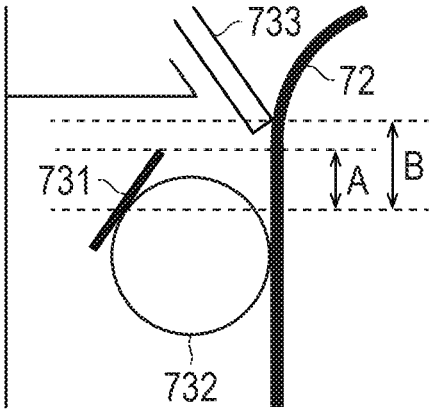

As shown in FIGS. 5, 7A and 7B more preferably, the storage space is formed only by the plate member 731 and the applying roller 732. This is because in the case where the storage space is formed only by the plate member 731 and the applying roller 732, cleaning failure due to excessive storage is reliably prevented, for example, even when the fluidity of the toner deteriorates and the height of the liquid level of the toner fluctuates.

Example

Hereinafter, embodiments of the present invention will be described in more detail with examples. However, the present invention is not limited by the examples at all.

Figure 8:
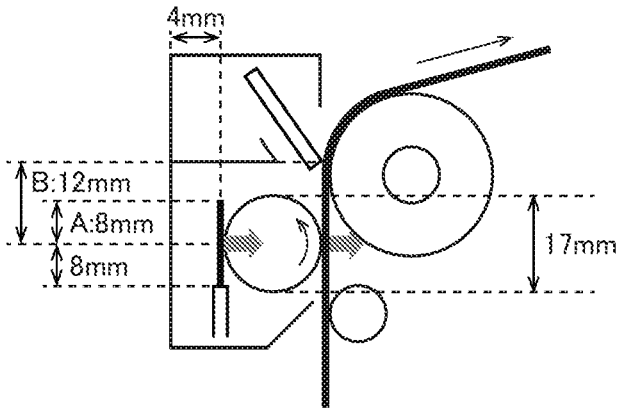
FIG. 8 is an illustration showing a schematic configuration of a cleaning device in an example.

FIG. 8 is an illustration showing a schematic configuration of a cleaning device in an example.

A cleaning device having the same configuration as that of the above-described embodiment was used. As a plate member, a member having a thickness of 70 nm made of SUS 304-CSP was used. As shown in FIG. 8, the distance A from the center of the contact portion of the plate member and the applying roller (the center of the nip) to the upper end (free end) of the plate member was set to 8 mm, and the distance B from the center of the contact portion to the lower end of the blade was set to 12 mm. The distance from the center of the contact portion to the lower end (fixed end) of the plate member was set to 8 mm.

The distance from the upper end of the plate member to the inner wall of the housing (the side wall of the cleaning device) was set to 4 mm. Further, the distance from the surface passing through the upper end of the plate member (the estimated liquid level of the toner in the storage space) to the inner wall of the housing (the upper wall of the cleaning device) was also set to 4 mm. When these distances were set to less than 3 mm, there was a concern that packing (clogging) of the toner occurs, the flowability of the toner which tends to overflow from the storage space deteriorate, and toner discharge is hindered, so that these distances were set to 3 mm or more.

As an applying roller; a roller having an outer diameter of 17 mm composed of nitrile rubber (NBR: Nitrile Butadiene Rubber) was used. For an elastic layer of the applying roller, a foamed sponge having a thickness of 2 mm and a hardness (Acker C hardness) of 30° was used. The applying roller was rotated at a linear velocity ratio of 0.45 with respect to the intermediate transfer belt, in the with direction (the direction in which the contact surfaces move in the same direction) with respect to the rotation direction of the intermediate transfer belt. In this way, the applying roller was configured to impart the ribbing force in addition to the pressing force with respect to the intermediate transfer belt, whereby the toner was more efficiently applied to the applying roller. Further, the bite amount of the applying roller to the intermediate transfer belt was set to 1.3 mm.

As a blade, a member made of urethane rubber was used. The contact pressure of the blade against the intermediate transfer belt was set to 27 N/m and the contact angle was set to 19°.

Example 1

The contact force of the plate member to the applying roller and the pressing force of the applying roller to the intermediate transfer belt were changed to evaluate abrasion of the cut surface of the blade.

Figure 9:
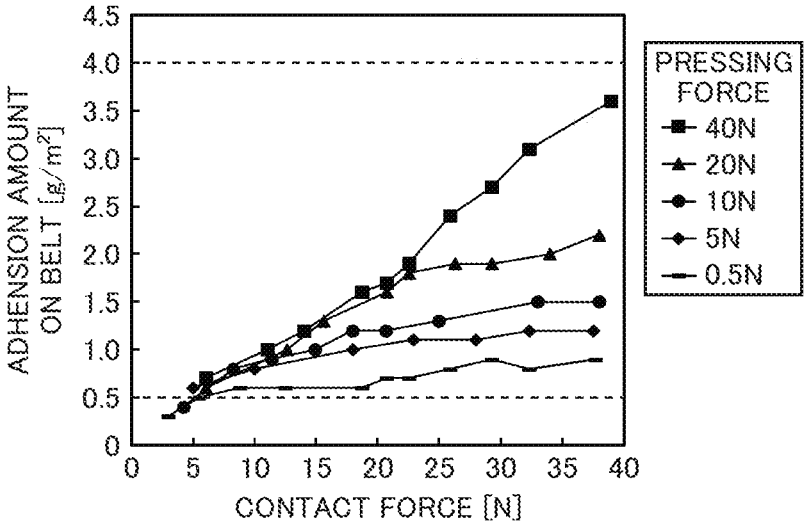
FIG. 9 is an illustration showing evaluation results of abrasion of cut surface when contact force and pressing force are changed.

FIG. 9 is an illustration showing evaluation results of abrasion of the cut surface when the contact force and the pressing force are changed.

As shown in FIG. 9, when the contact force of the plate member to the applying roller was set to 5 N or more and less than 40 N, and the pressing force of the applying roller to the intermediate transfer belt was set to 0.5 N or more and less than 40 N, it was found that abrasion of the cut surface and cleaning failure of the blade were prevented. In this case, the adhesion amount of toner on the applying roller was 5 g/m$^2$ or more and less than 50 g/m$^2$, and the adhesion amount of toner on the intermediate transfer belt was 0.5 g/m$^2$ or more and less than 4 g/m$^2$.

On the other hand, when the contact force of the plate member was set to less than 5 N, a sufficient amount of toner was not applied to the applying roller by the plate member, so that the adhesion amount of toner on the applying roller was less than 5 g/m$^2$, and as a result, abrasion of the cut surface of the blade occurred. When the contact force of the plate member was set to 40 N or more, an excessive amount of toner was applied to the applying roller by the plate member, so that the adhesion amount of toner on the applying roller was 50 g/m$^2$ or more, and as a result, cleaning failure occurred.

Further, when the pressing force of the applying roller was set to less than 0.5 N, a sufficient amount of toner was not applied to the intermediate transfer belt by the applying roller, so that the adhesion amount of toner on the intermediate transfer belt was less than 0.5 g/m$^2$, and abrasion of the cut surface of the blade occurred. When the pressing force of the applying roller was set to 40 N or more, an excessive amount of toner was applied to the intermediate transfer belt by the applying roller, so that the adhesion amount of toner on the intermediate transfer belt was 4 g/m$^2$ or more, which exceeds the cleaning limit, and cleaning failure occurred.

Further, when the contact force of the plate member was set to 15 N or more and less than 30 N, and the pressing force of the applying roller was set to 10 N or more and less than 20 N, it was found that even when there was an influence of disturbance such as the use environment of the cleaning device, the amount of toner necessary for preventing abrasion of the cut surface was stably supplied to the blade.

Example 2

The holding state of toner of the foamed sponge was evaluated by changing the cell diameter and the cell occupancy rate per unit area in the foamed sponge constituting the elastic layer in the applying roller.

A surface photograph of the applying roller was taken, and the diameter of the cell (cell diameter) existing within the unit area (1 mm×1 mm) was measured. Also, the cell area was calculated based on the measured cell diameter, and the cell occupancy rate per unit area was calculated by dividing the total value of the cell areas within the unit area by the unit area.

Table 1 shows the evaluation results of the holding state of toner of the foamed sponge when the cell diameter and the cell occupancy rate per unit area are changed.

TABLE 1

| | | Cell occupancy rate per unit area [%] | | | | | | |
|---|---|---|---|---|---|---|---|---|
| | | 20 | 30 | 40 | 50 | 60 | 70 | 80 |
| Average cell diameter [μm] | 100 | x | ○ | ○ | ○ | ○ | ○ | x |
| | 150 | ○ | ○ | ○ | ○ | ○ | ○ | x |
| | 200 | ○ | ○ | ○ | ○ | ○ | ○ | x |
| | 250 | ○ | ○ | ○ | ○ | ○ | ○ | x |
| | 300 | ○ | ○ | ○ | ○ | ○ | ○ | x |
| | 350 | ○ | ○ | ○ | ○ | ○ | ○ | x |
| | 400 | x | x | x | x | x | x | x |

As shown in Table 1, when the cell diameter was set to 100 μm or more and 350 μm or less, and the cell occupancy rate per unit area was set to 30% or more and less than 70%, it was found that the amount of toner necessary for preventing abrasion of the cut surface of the blade was retained in the foamed sponge.

On the other hand, when the cell diameter was set to less than 100 μm and the cell occupancy rate per unit area was set to less than 30%, the amount of toner necessary for preventing abrasion of the cut surface of the blade was not retained in the foamed sponge.

Also, when the cell diameter was set to more than 350 μm, the foamed sponge was spongy in the thickness direction of the foamed sponge constituting the elastic layer. For this reason, there was a possibility that the foamed sponge is scraped off by bringing the plate member in contact with the applying roller or by pressing the applying roller against the intermediate transfer belt. When the foamed sponge is scraped off, the outer diameter of the applying roller becomes smaller, and the bite amount of the plate member to the applying roller and the bite amount of the applying roller to the intermediate transfer belt become smaller, whereby the amount of toner necessary for preventing abrasion of the cut surface of the blade is not retained in the foamed sponge.

Further, when the cell occupancy rate per unit area was set to 80% or more, the contact area of the plate member and the non-cell portion of the applying roller, and the contact area of the intermediate transfer belt and the non-cell portion of the applying roller were reduced. For this reason, there was a possibility that the contact force of the plate member to the applying roller, and the pressing force of the applying roller to the intermediate transfer belt concentrate on the non-cell portion, so that the cell skeleton breaks up. When the cell skeleton breaks up, the volume of the foamed sponge decreases, whereby the amount of toner necessary for preventing abrasion of the cut surface of the blade is not retained in the foamed sponge.

Example 3

The contact state of the plate member was evaluated by changing the thickness of the plate member which was a metal leaf spring, from 70 μm.

Table 2 shows the evaluation results of the contact state of the plate member to the applying roller when the thickness of the plate member is changed.

TABLE 2

| Thickness of the plate member [μm] | Securing of the contact force of the plate member to the applying roller | Contacting uniformity of the plate member to the applying roller |
|---|---|---|
| 30 | x | ○ |
| 50 | ○ | ○ |
| 70 | ○ | ○ |
| 100 | ○ | ○ |
| 150 | ○ | ○ |
| 200 | ○ | ○ |
| 250 | ○ | x |

As shown in Table 2, when the thickness of the plate member was set to 50 μm or more and less than 200 μm, it was found that the contact force of the plate member to the applying roller and the uniformity of the contact were secured.

On the other hand, when the thickness of the plate member was set to less than 50 μm, the contact force of the plate member was not secured, so that a sufficient amount of toner was not applied to the applying roller by the plate member. When the thickness of the plate member was set to 200 μm or more, there was a case where the followability of the plate member with respect to the applying roller deteriorated, for example, the plate member did not come in contact with the applying roller, and a stable nip was not secured, so that the toner was not uniformly applied to the applying roller.

Example 4

The applying performance of the plate member was evaluated by changing the bite amount of the plate member to the applying roller. In Example 4, elastic deformations of the plate member and the applying roller were not considered.

When the bite amount of the plate member to the applying roller was set to 0.5 mm or more and less than 3 mm, it was found that the applying performance of the plate member was secured. On the other hand, when the bite amount was set to less than 0.5 mm, the contact force of the plate member to the applying roller was not secured, so that a sufficient amount of toner was not applied to the applying roller. When the bite amount was set to 3 mm or more, an excessive amount of toner was applied to the applying roller, and as a result, cleaning performance deteriorated.

Example 5

Abrasion of the cut surface of the blade was evaluated under the condition that the holding state of toner of the foamed sponge in Example 2, the contact state of the plate member in Example 3, and the applying performance of the plate member in Example 4 were all satisfactory.

That is, the cell diameter in the foamed sponge constituting the elastic layer in the applying roller was set to 100 μm or more and 350 μm or less, and the cell occupancy rate per unit area was set to 30% or more and less than 70% (Example 2). Further, the thickness of the plate member was set to 50 μm or more and less than 200 μm (Example 3). In addition, the bite amount of the plate member to the applying roller was set to 0.5 min or more and less than 3 mm (Example 4).

Table 3 shows the evaluation results of abrasion of the cut surface of the blade when the contact force of the plate member and the pressing force of the applying roller are changed. In Table 3, "a" means that abrasion of the cut surface of the blade did not occur, "A" means that abrasion of the cut surface of the blade occurred, and "x" means that the edge of the blade is worn out with abrasion of the cut surface of the blade as a starting point, and cleaning failure occurred.

TABLE 3

| The number of sheets passed [kp] | Contact force: 2N Pressing force: 0.6N | Contact force: 15N Pressing force: 18N |
|---|---|---|
| 50 | ○ | ○ |
| 100 | ○ | ○ |
| 200 | Δ | ○ |
| 300 | x | ○ |
| 400 | x | ○ |
| 500 | x | ○ |

As shown in Table 3, when the contact force of the plate member to the applying roller was set to 5 N or more and less than 40 N, and the pressing force of the applying roller to the intermediate transfer belt was set to 0.5 N or more and less than 40 N, it was found that abrasion of the cut surface of the blade was prevented over a long period of time, and stable cleaning performance was secured.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning device comprising:

a cleaning blade that comes in contact with an image carrier and cleans the image carrier;

an applying roller that comes in contact with the image carrier upstream of the cleaning blade in a conveying direction of the image carrier, and applies toner to the image carrier; and a plate member that comes in contact with the applying roller and applies the toner to the applying roller, wherein contact force of the plate member to the applying roller is 5 N or more and less than 40 N, and pressing force of the applying roller to the image carrier is 0.5 N or more and less than 40 N, an amount of the toner applied to the applying roller by the plate member is 5 $g/m^2$ or more and less than 50 $g/m^2$, and an amount of the toner applied to the image carrier by the applying roller, and supplied to the cleaning blade is 0.5 $g/m^2$ or more and less than 4 $g/m^2$.

2. The cleaning device according to claim 1, wherein the plate member is disposed so that a non-edge portion of the plate member comes in contact with the applying roller.

3. The cleaning device according to claim 1, wherein the plate member and the applying roller are disposed so as to form a space for storing the toner above a contact portion of the plate member and the applying roller, the plate member applies the toner stored in the space to the applying roller, and an upper end of the plate member is a free end, and the toner exceeding a capacity of the space is discharged downward from the free end.

4. The cleaning device according to claim 3, wherein a position of the upper end of the plate member is lower than a position of a lower end of the cleaning blade.

5. The cleaning device according to claim 1, wherein the plate member is a metal leaf spring material having a thickness of 50 μm or more and less than 200 μm, and a bite amount of the plate member to the applying roller is 0.5 mm or more and less than 3 mm.

6. The cleaning device according to claim 1, wherein the applying roller has an elastic layer composed of a foamed sponge.

7. An image forming apparatus comprising:

the image carrier; and the cleaning device according to claim 1, wherein the image carrier is an intermediate transfer belt.

* * * * *